United States Patent [19]

Schulze et al.

[11] 4,279,614

[45] Jul. 21, 1981

[54] PROCESS FOR DYEING POLYESTER-CONTAINING MATERIALS

[75] Inventors: Hans Schulze, Cologne; Klaus Walz, Leverkusen; Karlhans Jakobs, Bergisch-Gladbach; Günther Boehmke, Leverkusen, all of Fed. Rep. of Germany

[73] Assignee: Bayer Aktiengesellschaft, Leverkusen, Fed. Rep. of Germany

[21] Appl. No.: 93,951

[22] Filed: Nov. 14, 1979

[30] Foreign Application Priority Data

Dec. 1, 1978 [DE] Fed. Rep. of Germany ..... 2852027

[51] Int. Cl.[3] ..... D06P 3/872; D06P 3/84; D06P 3/82; D06P 1/90

[52] U.S. Cl. ..... 8/533; 8/616

[58] Field of Search ..... 8/94 A, 175, 533, 616

[56] References Cited

U.S. PATENT DOCUMENTS

| | | | |
|---|---|---|---|
| 3,644,080 | 2/1972 | McCullough et al. | 8/175 |
| 3,792,970 | 2/1974 | Neeff | 8/94 |
| 3,894,842 | 7/1975 | Birke et al. | 8/175 |
| 3,992,143 | 11/1976 | Sommer et al. | 8/94 A |
| 4,013,408 | 3/1977 | Liechti et al. | 8/94 A |
| 4,018,558 | 4/1977 | Liechti et al. | 8/94 A |

OTHER PUBLICATIONS

Schmidlin, H. U. Preparation & Dyeing of Synthetic Fibers, Chapman & Hall Ltd. London, 1963, p. 397.

Schnider, E. F. Amer. Dyestuff Reporter, May 13, 1963, p. 52.

*Primary Examiner*—Joseph L. Schofer

*Assistant Examiner*—Maria Parrish Tungol

*Attorney, Agent, or Firm*—Sprung, Felfe, Horn, Lynch & Kramer

[57] ABSTRACT

Dyeing of structures made of polyesters or cellulose esters with disperse dyestuffs is carried out in the presence of chlorinated alkylbenzenes of the general formula

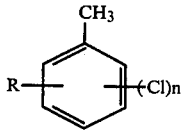

in which n=1–3 and

R=H or alkyl with 1–4 carbon atoms.

4 Claims, No Drawings

PROCESS FOR DYEING POLYESTER-CONTAINING MATERIALS

The invention relates to a process for dyeing structures made of polyesters or cellulose esters with disperse dyestuffs; the process is characterised in that dyeing or printing is carried out in the presence of chlorinated alkylbenzenes of the general formula

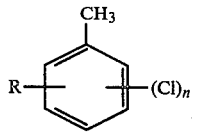

(I)

in which n=1–3 and

R=H or alkyl with 1–4 carbon atoms.

The requisite amounts of the chlorinated alkylbenzenes of the formula (I), which are to be used according to the invention, can be determined easily from case to case by preliminary experiments. In general, amounts of 1 to 7 g per liter of dye liquor, with the customary liquor ratios of 1:5–1:40, and of 10 to 40 g per liter of padding liquor have proved suitable.

Since the chlorinated alkylbenzenes to be used according to the invention are readily compatible with other carriers, they can also be used as a mixture with other known carriers.

The chlorinated alkylbenzenes of the formula (I) which are to be used according to the invention are advantageously employed together with anionic or nonionic emulsifiers or dispersing agents. Emulsifiers which have proved particularly suitable are mixtures of (a) oxethylated oils, such as castor oil or soya bean oil, oxethylated alcohols, alkylphenol polyglycol ethers or phenylalkylphenol polyglycol ethers and (b) alkali metal salts, alkaline earth metal salts and/or ammonium salts of organic sulphonic acids containing at least 10 carbon atoms, such as dodecylbenzenesulfonic acid, diisobutylnaphthalenesulphonic acid, α-sulpho-fatty acids and ricinoleyl-methyltauride. The amounts of emulsifiers or dispersing agents are appropriately 5 to 15% of the weight of the carrier formulation.

The disperse dyestuffs which are used in the dyeing process according to the invention are the dyestuffs customarily used for dyeing polyesters and cellulose esters, such as those dyestuffs described, for example, in the "Colour Index" volume 2, pages 2,483–2,741, 3rd edition (1971). Dyeing of the structures consisting of polyesters or cellulose esters, in the presence of the chlorinated alkylbenzenes to be used according to the invention, is carried out by the continuous or discontinuous processes customary for dyeing with disperse dyestuffs; processes which may be mentioned are: the customary process which operates at 98° C., the high temperature process and the thermosol process.

Examples which may be mentioned of representatives of the compounds of the formula (I) to be used according to the invention are: the isomeric mono-, di- and tri-chlorotoluenes, 4-chloro-1,3-dimethylbenzene, 2-chloro-1,4-dimethylbenzene and 2,5-dichloro-1,4-dimethylbenzene.

Dichlorotoluenes of the general formula

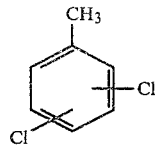

(II)

have proved particularly advantageous in the process according to the invention. In particular, the mixtures of isomers, which are obtained from the industrial chlorination of toluene, have proved particularly suitable.

With the aid of the process according to the invention it is possible to dye structures, for example filaments, fibres, woven fabrics, knitted fabrics, films and sheets, made of polyesters, such as polyterephthalic acid glycol esters, or polyesters of 1,4-bis-(hydroxymethyl)-cyclohexane and terephthalic acid, and cellulose esters, for example cellulose triacetate, with disperse dyestuffs in deep shades and outstandingly uniformly.

The chlorinated alkylbenzenes to be used according to the invention are particularly suitable for dyeing polyester/wool mixed fabrics, because soiling of the wool constituent by the disperse dyestuffs is prevented when these compounds are used.

Many compounds, such as halogenobenzenes, alkylphthalimides, aromatic carboxylic acid esters, methyl- and methoxy-naphthalenes, diphenyl, diphenyl ether, o-, m- and p-hydroxydiphenyls or p-hydroxydiphenyl ether, have already been proposed as carriers for dyeing polyester materials. However, these compounds have disadvantages.

All of the compounds except for the alkylphthalimides have very troublesome odours. Mono- and dichlorobenzenes are highly hepatotoxic, whilst the methyl-and methoxy-naphthalenes have the disadvantage that they have an adverse effect on the fastness to light of the dyeings. Diphenyl does indeed possess good carrier characteristics, but has the disadvantage that it causes spots on the textiles because, due to its high melting point, it crystallises out easily in the dyebaths and does not emulsify well when the baths are heated. Diphenyl ether has the disadvantage that its carrier activity is highly dependent on the constitution of the disperse dyestuff used and that, for this reason, reproducible dyeings are not obtained when dyeing is carried out with dyestuff combinations, for example those for the production of grey and olive shades. p-Hydroxydiphenyl does indeed possess good carrier characteristics, but cannot be employed as a carrier in the normal dyeing process at 98°–100° C. because it is still solid at these temperatures. Moreover, it impairs the fastness to light of the dyeings.

Compared with these said carriers, the chlorinated alkylbenzenes to be used according to the invention have the advantages that they do not cause any spots, that they do not adversely influence the fastness to light of the dyeings, that their activity is independent of the constitution of the dyestuffs, that, therefore, reproducible combination dyeings can be produced with the aid of these compounds and that inconvenience due to troublesome odours is slight.

Compared with the alkylphthalimides mentioned, the chlorinated alkylbenzenes have the advantage that they are already effective in lower concentrations. Moreover, it should be emphasised that if they do not even improve the build-up of the disperse dyestuffs, they at the least do not impair this, as is the effect of other carriers which retain the dyestuffs in the dyebath. The excellent compensating capacity for differences in the filament structure of thermofixed polyester material may also be mentioned as a further advantage.

A combination with 1,2,4-trichlorobenzene has proved particularly advantageous. Whilst a pure formulation of trichlorobenzene already crystallises out at +10° C. to +17° C., suitable combinations with dichlorotoluenes have solidification points down to −20° C.

EXAMPLE 1

Using a liquor ratio of 1:40, yarns made of polyester fibres are introduced into a bath which has been warmed to 60° C. and contains, per liter, 0.25 g of a dyestuff of the formula

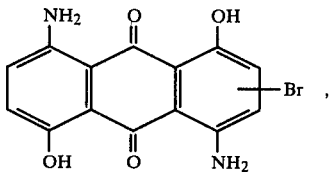

2 g of a condensation product of naphthalenesulphonate and formaldehyde, 2 g of sodium dihydrogen phosphate, 3 g of a compound of the formula

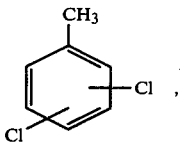

0.3 g of oxethylated castor oil and 0.3 g of a monoethanolamine salt of dodecylbenzenesulphonic acid. The pH value of the bath is adjusted to pH 4.5–5 with acetic acid. The bath is then heated to 98° C. and kept at this temperature for 60 minutes. A uniform blue dyeing is obtained.

EXAMPLE 2

Using a liquor ratio of 1:40, piece goods consisting of polyester spun fibre in the warp and the weft are introduced into a bath which has been warmed to 50° C. and contains, per liter, 0,2 g of a dyestuff of the formula

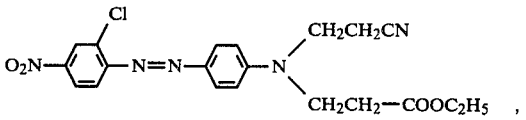

2 g of a condensation product of naphthalenesulphonate and formaldehyde, 2 g of sodium dihydrogen phosphate, 1.6 g of a compound of the formula

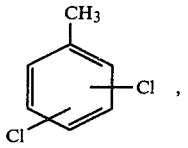

0.5 g of 1,2,4-trichlorobenzene, 0.2 g of an oxethylated castor oil and 0.15 g of a monoethanolamine salt of dodecylbenzenesulphonic acid. The pH value of the bath is adjusted to pH 4.5–5 with acetic acid. The dye liquor is then brought up to the boil and kept at this temperature for one hour. A full, uniform red dyeing is obtained.

EXAMPLE 3

Using a liquor ratio of 1:15, polyester spun fibres are introduced into a liquor which contains, per liter, 1 g of a disperse dyestuff according to Example 1, 0.18 g of a disperse dyestuff according to Example 2, 0.03 g of a dyestuff according to the Colour Index, 2nd edition (1956), volume 3, No. 12,790, 2 g of a condensation product of formaldehyde and naphthalenesulphonate, 2 g of sodium dihydrogen phosphate, 2.3 g of a compound of the formula

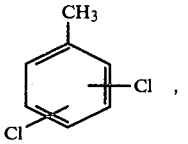

0.7 g of 1,2,4-trichlorobenzene, 0.25 g of an oxethylated castor oil and 0.22 g of a monoethanolamine salt of dodecylbenzenesulphonic acid. The pH value of the liquor is adjusted to pH 4.5–5 with acetic acid. The liquor is then heated slowly to 98° C. and the fibres are treated for one hour at this temperature. A dark red-brown dyeing is obtained.

We claim:

1. In the dyeing of a polyester and wool-containing fibre material wherein the fibre material is dyed in an aqueous dyebath containing a dyestuff for the polyester and a carrier for the polyester dyestuff, the improvement comprises employing as said carrier a chlorinated alkylbenzene of the formula

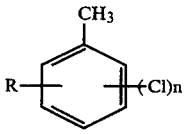

in which n = 1–3 and

R = H or alkyl with 1–4 carbon atoms.

2. A process according to claim 1, wherein n is 2 and R is hydrogen.

3. A process according to claim 1, wherein the carrier comprises a mixture of at least two compounds wherein n is 2 and R is hydrogen.

4. A process according to claim 1, including adding an emulsifier to the dyebath.

* * * * *